United States Patent [19]

Poulsen

[11] Patent Number: 4,831,910

[45] Date of Patent: May 23, 1989

[54] FRAME LIST CUTTING MACHINE AND A KNIFE THEREFOR

[76] Inventor: Oluf K. Poulsen, Kresten Koldsvej 7, 8230 Aabyhöj, Denmark

[21] Appl. No.: 126,473

[22] Filed: Nov. 30, 1987

Related U.S. Application Data

[63] Continuation of Ser. No. 843,667, Mar. 26, 1986, abandoned.

[51] Int. Cl.[4] ..... B27G 5/00

[52] U.S. Cl. ..... 83/693; 83/620; 83/636; 83/699; 83/917; 83/926 H; 144/217

[58] Field of Search ..... 144/216, 217; 83/620, 83/636, 692, 693, 698, 699, 581, 917, 926 H

[56] References Cited

U.S. PATENT DOCUMENTS 707,734 8/1902 Tyler ..... 144/217

3,046,825 7/1962 Thompson ..... 83/698

4,455,904 6/1984 Harner et al. ..... 83/375

*Primary Examiner*—Frank T. Yost

*Assistant Examiner*—Eugenia A. Jones

*Attorney, Agent, or Firm*—Antonelli, Terry & Wands

[57] ABSTRACT

A list cutting machine for producing mitered frame list members an angular cutter head is used for providing a V-shaped overcutting of a supply frame list by two knives, which abut each other at the middle of the cutter head and project therefrom inclined both rearwardly and downwardly. Practice has shown that the innermost halves of the knives are subjected to wear, much more than the outer halves, but the knives cannot normally be turned for increased durability. However, a lifetime-increasing turning is possible when both of the knives are similarly shaped at both ends and are remounted mutually interchanged.

5 Claims, 1 Drawing Sheet

FRAME LIST CUTTING MACHINE AND A KNIFE THEREFOR

This is a continuation application of Ser. No. 843,667, filed Mar. 26, 1986, now abandoned.

BACKGROUND OF THE INVENTION

The present invention relates to a frame list cutting machine of the type having a cutter head for producing a V-shaped incision in a list member from one side thereof and thereby to effect severing of the list member, primarily for producing exactly mitered list pieces, said machine having an elongated supported table for supporting list members of various widths and provided with a V-shaped notch for receiving the cutter head by the cutting movement thereof, said cutter head being provided with two knife members arranged such that their cutting edges are located along the outer contour of the V-shaped knife member assembly, while the cutting edges, from the top point of the V-shaped knife structure, project along respective lines inclined relative the moving direction of the cutter head with a length such that the projection of the cutting edges onto the support table will at least roughly correspond to the shape and the length of the sides or edges of the V-notch of the support table.

Frame lists for picture frames may be cut in mitre by sawing, but for achieving corner joints of high quality the cuttings shall be absolutely clean, which is obtainable by means of a cutting machine of the above type. The list to be cut is placed on the elongate support table across the V-notch thereof and laterally against a guiding rail along the side of the support table at which the top point of the V-notch is located, and the cutter head is forced down for carrying out the V-incision in the list, normally by more operations, by which the cutter head is stepwise moved more and more inwardly over the list, such that the last cut, by which the list is cut over, will involve removal of a relatively thin end plate or slice portion from the list or rather from the respective ends of the two separate list lengths as separated by the over-cutting of the list. By this last operation the knives pass down along the edges of the V-notch in the support table, and it is essential, of course, that the cutting edges of the knives be located along the outer contour of the V-shaped knife system, i.e. the outsides of the knife plate members should project straightly upwardly from the cutting edges, that is in the upward moving direction of the cutter head, while the inclined cutting edge side should be located at the opposite, inner side of the knife plate member. The knives have to be rather heavily dimensioned, whereby they should also be rather thick, and by each cutting operation, therefore, they will produce a considerable displacement of the material being cut. A resulting consequence is the said desire of cutting off, by the last cutting operation, only a narrow slice portion of the list material in order to obtain an entirely clean final cutting of the resulting list ends.

The two knives have to meet in the top point of the V-structure such that the respective ends of the cutting edges thereof are brought entirely together in this point. It is a resulting requirement that the interengaging end surfaces of the knife plate members should be correspondingly oblique to enable such a meeting of the knife members in the said top point area.

Moreover, the two knife members are normally arranged in mutual angular relationship not only corresponding to the V-notch in the support table, but also in the direction normal to the support table, i.e. in the moving direction of the cutter head, such that the knives, from their said top point, are inclined both rearwardly and downwardly. Hereby the cutting into the lists will take place in a progressive manner, which is a practical necessity. It is hereby usual advantageous that the adjacent ends of the knife plates abut each other also above the top point of the cutting edges, and in this abutment area the end faces of the knife plates should thus be oblique relative the knives. Here the knife ends should be cut obtuse-angled relative the cutting edge, while the same end surfaces, as mentioned above should be acute-angled in the cross direction.

Thus, the adjacent knife ends have to be machines in a special and accurate manner, while the outer knife ends can be left with any simple shape.

The knives, which are rather expensive elements, will be worn in use, but they can be demounted for sharpening, and already for this reason it is important that the knives meet each other also above the top point of the cutting edges, because these edges will then meet each other again when the knives, after the sharpening, are remounted in unchanged positions.

The knives are totally symmetrical about their meeting plane at the said top point, but they cannot replace each other, i.e. they are present as a set of two different knives.

On this background the invention takes its starting point in the finding that the knives, in practice, are worn most on their respective halves adjacent the top point of the knife structure, i.e. more than on their outer halves. This is mainly due to the fact that ordinary list cutting machines are adapted to handle lists of different widths, up to a relatively large width, while in practice the vast majority of lists actually handled are relatively narrow, i.e. the outer half of the knives are only seldom in operation. On this background it has been realized that it would be advantageous if the knives were turnable to make the outer halves operative after some time, but the required basic shape of each knife simply forbids such a turning, which would imply an operatively impossible location of the inclined side of the cutting edge at the outside of the V-knife structure.

The invention is based on the consideration that the knives are in fact turnable into new, fully operational positions, provided they are hereby additionally interchanged and mounted with their formerly outer ends meeting at the top area of the reproduced V-knife structure. According to the invention, for enabling such a remounting of the knives the list cutting machine is characterized in that each of the two knives are shaped symmetrically about a central cross plane in such a manner that the knives are interchangeable on the cutter head to form a reestablished V-shaped knife member assembly with inverted length orientation of each of the knives.

When the knives are thus similarly shaped at both ends each knife will be mountable on either side of the cutter head, and the knives will be interchangeable, therefore, when they are additionally turned in such a manner that their formerly outer ends are now brought into the inner area of the V-knife structure. Here they will be exposed to an increased wear, as explained, while the formerly inner halves of the knives will be exposed to a reduced wear, such that the lifetime of the knives will be noticeably prolonged.

Another and important consequence of the invention is that the two knives of the knife set may now be entirely similar, whereby the extra machining work required for the shaping of the "outer" end of the knives, will already to some degree be compensated for by the fact that it will no longer be necessary to distinguish between knives for the respective left and right sides of the cutter head.

The invention also comprises the said knives as provided with symmetrically shaped opposite end portions. Obviously such a knife will be more expensive than the previously known knives, of which only one end has been finely machined, but the extra price is more than compensated for by the fact that the knife or a set of such knives will be turnable for the achievement of an almost doubled durability under normal conditions of use.

In the following the invention is described in more detail with reference to the drawing, in which:

DETAILED DESCRIPTION

Figure 1:
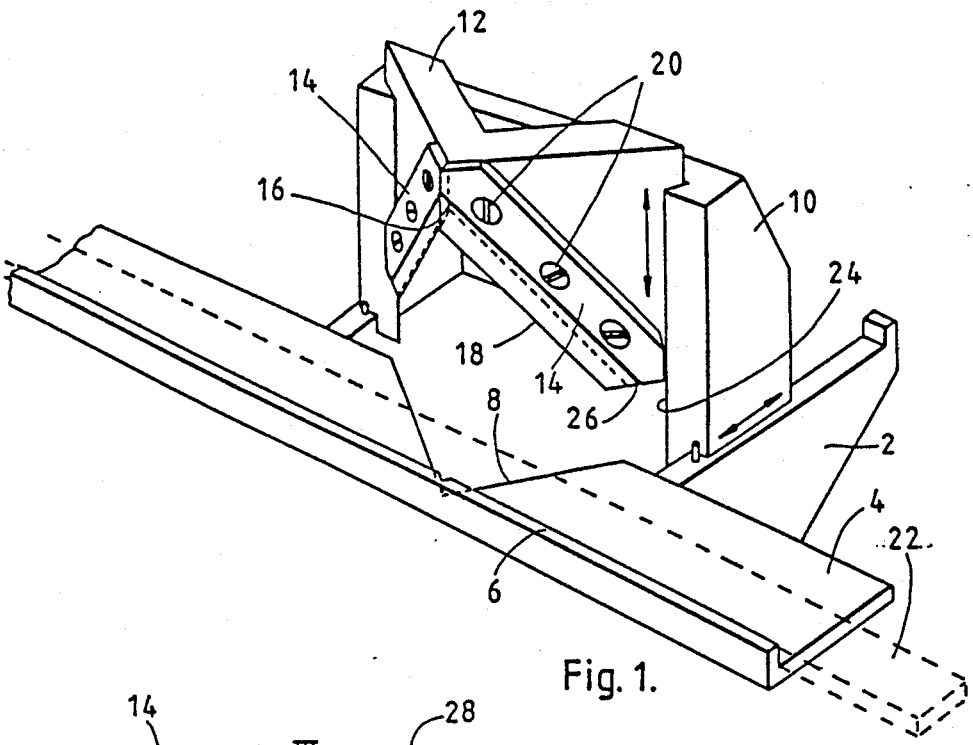
FIG. 1 is a schematic perspective view of a list cutting machine according to the invention.

The list cutting machine shown in FIG. 1 is of a generally fully conventional main design. It comprises a machine frame 2 carrying as elongate support table 4, which is provided with an upstanding, rigid guiding rail 6 along its foremost edge. From its opposite edge the support table is provided with a V-shaped notch 8, the top point of which is located immediately adjacent the interior side of the guiding rail 6.

The frame 2 serves to guide a guiding block 10 horizontally against and away from the rear edge of the support plate 4, said guiding block 10 being provided with vertical guiding grooves receiving an angular cutter head 12 which, at its front side, is provided with two longish knife plates 14 meeting each other along a vertical meeting plane 16, from which they extend inclined both vertically and horizontally. The knives 14 are rearwardly inclined so as to form respective angles of exactly 45° relative the direction of the guiding rail 6, while the downward inclination of the knives is less critical. The front sides of the knives extend in the vertical plane and terminate bottomwise in a cutting edge 18, from which the knife material at the insides of the knives projects obliquely inwardly and upwardly towards a planar inner side, with which the knives are tightened against the cutter head. This tightening is effected by means of screw holes and screws 20, which are located symmetrically about a central cross plane of each knife 14.

The cutting edges 18 of the two knives meet in an upper top point at the lower end of the meeting area 16. When the cutter head 12 is moved downwardly by suitable actuator means (not shown) the knives 14 will produce a V-shaped incision in a list 22 placed on the support table 4 along the guiding rail 6, and by a stepwise advancing of the guiding block 10 the list will hereby at last be entirely cut over, namely when the knife point area 16 is moved down immediately along the interior side of the guiding rail 6, whereby the knives 14 are moved down immediately inside the edges of the V-notch 8 in the support table 4.

The list 22 has now been cut over by fully clean mitre cuts, and the next cutting may then be effected upon measuring out the required length of the next frame list member.

All this is well known in the art.

The support table 4 is broad enough to be able to support rather broad frame lists, and the knives 14 are correspondingly long enough to be able to effectively cut such broad lists. In practice, however, the majority of the lists to be handled are considerably narrower, e.g. as shown by the width of the list 22, such that the outer or lower half of the knives 14 will only seldom participate in the list cutting, i.e. they are worn considerably less than the inner/upper halves.

As shown in dotted lines the outer/lower ends of the knives 14 of the prior art have been shaped as simple end surfaces 24, which would be entirely unfit for forming a top surface at the upper end of the knives by an imagined turning of the knives.

According to the invention, however, the outer ends of the knives are shaped quite similarly to the upper ends thereof, i.e. having surface portions 26 which are double-oblique in such a manner that upon combined turning and interchanging of the knives these surface portions will be located in a top joint, which is entirely similar to the original joint along the plane 16. The only difference will be that after the rearrangement of the knives it will be the originally outermost halves of the knives which will now be located as the innermost halves and correspondingly take over the majority of the cutting work and the associated wear.

Figure 2:
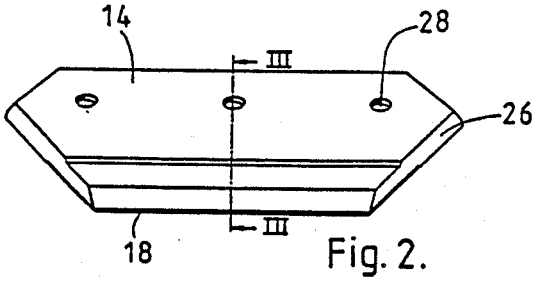
FIG. 2 is a perspective view of a knife member seen from the rear.
Figure 3:
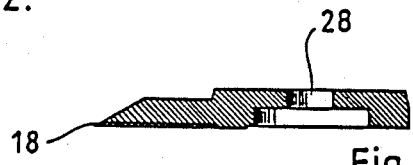
FIG. 3 is a sectional view along the line III—III in FIG. 2.
Figure 4:
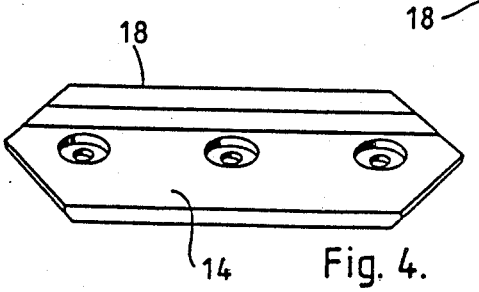
FIG. 4 is a perspective front view of the knife member.

In FIG. 2–4 is shown a single knife 14. It is well known that such a knife may have, at one end, a double-oblique end surface 26, which will condition a close abutment with a correspondingly shaped end surface of the other knife in the area 16 of FIG. 1. According to the invention also the opposite end of the knife is shaped in the same manner, i.e. symmetrically with the first end about a central cross plane II—II of the knife.

In the illustrated preferred embodiment the knife 14 is provided with countersunk holes 28 for being mountable on the cutter head by means of the screws 20, and for enabling the knife to be remounted in a relatively unchanged position on the opposite leg of the cutter head it is important that also the holes 28 are provided symmetrically about the middle cross plane of the knife, such that both of the legs of the cutter head may be provided with only one set of screw holes corresponding to the holes 28.

What is claimed is:

1. A frame list cutting machine having a cutter head forming a V-shaped knife member assembly for producing a V-shaped incision in a list member form one side thereof to effect severing of the list member, primarily for producing exactly mitered list pieces, said list cutting machine having an elongated support table for supporting list members of various widths and provided with a V-shaped notch for receiving the cutter head by a cutting movement thereof, said cutter head being provided with two knife members arranged such hat cutting edges thereof are located along an outer contour of the V-shaped knife member assembly, while the cutting edges, from a top point of the V-shaped knife assembly, project along respective lines inclined relative to the moving direction of the cutter head with a length such that the projection of the cutting edges on the support table will at least substantially correspond to the shape and the length of the sides or edges of the V-notch of the support table, characterized in that each of the two knife members have a single cutting edge and are shaped symmetrically about a central cross plane in such a manner that the two knife members are interchangeable on the cutter heat to form a reestablished V-shaped knife member assembly with inverted length orientation of each of the two knife members, and wherein each end surface portion of each of the two knife members are oblique to said central cross plane in such a manner that upon combined turning and interchanging of the two knife members the surface portions will be located in a top joint which is entirely similar to the original joint between the two knife members prior to the turning and interchanging thereof.

2. A frame list cutting machine having an angular cutter head forming a V-shaped knife member assembly for producing a V-shaped incision in a list member from one side thereof to effect severing of the list member, primarily for producing exactly mitered list pieces, said list cutting machine having an elongated support table for supporting list members of various widths and provided with a V-shaped notch for receiving the cutter head by a cutting movement thereof, said cutter head being provided with two knife members arranged such that cutting edges thereof are located along an outer contour of the V-shaped knife member assembly, while the cutting edges, from a top point of the V-shaped knife assembly, project along respective lines inclined relative to the moving direction of the cutter head with a length such that the projection of the cutting edges onto the support table will at least substantially correspond to the shape and the length of the sides or edges of the V-notch of the support table, characterized in that each of the two knife members have a single cutting edge and are shaped symmetrically about a central cross plane in such a manner that the two knife members are interchangeable on the cutter head to form a re-established V-shaped knife member assembly with inverted length orientation of each of the two knife members, means for enabling each of the two knife members to be releasably fastened to a respective leg of the angular cutter head and having an end portion shaped such that one of the knife members is mounted on a first leg of the angular cutter head in endwise engagement with the other knife member mounted on the other leg of the angular cutter head, said end portion of each of the two knife members having a surface area which is oblique to the central cross plane of the knife member to enable said engagement with the other knife member, and in that the opposite end portion of each of the two knife members is shaped correspondingly for conditioning a remounting of each of the two knife members with inverted orientation, on the opposite leg of the cutter.

3. A knife blade for use on a cutter head of a list-cutting machine having a cutter head comprising a knife holder block having two knife supporting sides generally meeting along an intersection line so as to form an outer corner of 90°, said holder block having means for holding an elongate knife blade on each of said knife supporting sides such that respective end portions of the knife blades meet each other along said intersection line with respective longitudinally extending knife edges positioned so as to extend parallel with respect to the associated knife supporting sides and additionally obliquely relative to said intersection line, each forming an acute angle therewith whereby the knife edges of the two knife blades are located in a common plane which is obliquely relative to the intersection line, each of said knife blades being shaped generally as an elongate plate member having a first side and a second side about a single knife edge extending along one longitudinal edge of the plate member with said first side integrally forming one side of the knife edge and an outer edge portion of said second side forming a pronounced, acute angle with said first side so as to constitute the opposite side of the knife edge, said second side being adapted to engage said knife supporting side of said knife holder block, said elongated plate member having at one end a planar end surface located in a plane forming an obtuse angle with the longitudinal direction of the knife edge as viewed from a meeting point between said planar end surface and said knife edge and additionally forming an acute angle with said first side to the effect that two such knife blades are mountable on respective knife supporting sides of said knife holder block with their respective planar end surfaces abutting each other along said intersection line, each of said knife blades having an opposite end thereof shaped similarly to said one end, symmetrically therewith about a plane normal to the elongated plate member with respect to the longitudinal direction thereof so as to be interchangeable with the one end of the knife blade on the respective other knife supporting side of the knife holder block and remountable thereon with the other end of the knife blade engaging the corresponding other end of the other knife blade.

4. A knife blade according to claim 3, wherein corner portions between said planar end surface of both ends of the elongated plate member and the longitudinal edge thereof opposite to the knife edge are cut away along a line substantially perpendicular to the direction of the respective planar end surface as viewed in a plane of the elongated plate member.

5. A knife blade according to claim 3, wherein holes for mounting bolts are provided in a row parallel to a longitudinal direction of the elongated plate member and having a configuration symmetrically about the normal plane.

* * * * *